US007712402B2

(12) United States Patent
Ishii

(10) Patent No.: US 7,712,402 B2
(45) Date of Patent: May 11, 2010

(54) ADJUSTABLE SLICER

(75) Inventor: Takayuki Ishii, Takeda (JP)

(73) Assignee: Kyocera Tycom Corporation, Costa Mesa, CA (US)

( * ) Notice: Subject to any disclaimer, the term of this patent is extended or adjusted under 35 U.S.C. 154(b) by 726 days.

(21) Appl. No.: 11/228,638

(22) Filed: Sep. 16, 2005

(65) Prior Publication Data

US 2007/0062349 A1 Mar. 22, 2007

(51) Int. Cl.
*B26D 1/00* (2006.01)

(52) U.S. Cl. ..... 83/13; 83/436.7; 83/932; 83/856; 83/435.11; 30/279.6; 30/291

(58) Field of Classification Search ..... 83/436.7, 83/856, 906, 858, 698.11, 13, 932, 857, 435.11, 83/437.2, 431; 30/278, 283, 280, 289, 290, 30/291, 279.6
See application file for complete search history.

(56) References Cited

U.S. PATENT DOCUMENTS

| | | | | | |
|---|---|---|---|---|---|
| 66,402 | A | | 7/1867 | Schwartz | |
| 131,787 | A | | 10/1872 | Sawyer et al. | |
| 190,875 | A | | 5/1877 | Kuchinka | |
| 221,436 | A | | 11/1879 | Andrews | |
| 264,017 | A | * | 9/1882 | Winterbottom | 30/519 |
| 411,568 | A | | 9/1889 | Becker | |
| 513,833 | A | | 1/1894 | Sibbrel et al. | |
| 725,262 | A | | 4/1903 | Lallement | |
| 1,430,289 | A | | 9/1922 | Dahmer | |
| 1,714,413 | A | | 5/1929 | Woodward et al. | |
| 1,974,194 | A | * | 9/1934 | Phillips | 241/101.1 |
| 2,502,379 | A | | 3/1950 | Hein et al. | |
| 2,766,793 | A | | 10/1956 | Duszynski | |
| 4,038,892 | A | * | 8/1977 | Popeil | 83/874 |
| 4,120,089 | A | | 10/1978 | Borner | |
| 4,281,460 | A | | 8/1981 | Harris | |
| 4,290,196 | A | | 9/1981 | Borner | |
| 4,310,971 | A | | 1/1982 | Rowell | |
| 4,570,519 | A | | 2/1986 | Motosko, II | |
| 4,573,387 | A | | 3/1986 | Denter et al. | |
| 4,624,166 | A | | 11/1986 | Kreth et al. | |
| 4,733,588 | A | * | 3/1988 | Yamamoto | 83/857 |
| 4,790,488 | A | | 12/1988 | Borner | |
| 5,001,835 | A | | 3/1991 | Borner | |
| D326,388 | S | * | 5/1992 | Boerner | D7/381 |
| 5,745,999 | A | | 5/1998 | Zirkiev | |
| 2006/0075872 | A1 | * | 4/2006 | Wangler | 83/856 |
| 2007/0125207 | A1 | * | 6/2007 | Lucas et al. | 83/13 |

* cited by examiner

*Primary Examiner*—Boyer D Ashley
*Assistant Examiner*—Omar Flores-Sánchez
(74) *Attorney, Agent, or Firm*—Stetina Brunda Garred & Brucker

(57) ABSTRACT

A food slicer for slicing a food product is provided. The slicer may have an adjustable surface and a stationary surface with a blade interposed therebetween. The food product may be sliced with a specific thickness via the blade by traversing the food product from the adjustable surface to the stationary surface. A trailing edge of the adjustable surface and an edge of the blade may define a gap distance which determines a slicing thickness of the food product. A cam may contact an underside of the adjustable surface to set the gap distance. The gap distance may be reset by rotating the cam. More particularly, the cam may have a plurality of cam surfaces. Each of the cam surfaces may have a different distance to a rotating axis of the cam. The gap distance may be changed by rotating the cam such that a different cam surface contacts the adjustable surface's underside.

14 Claims, 5 Drawing Sheets

ADJUSTABLE SLICER

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to food slicers.

Commercial and residential food preparers may prepare a meal for business patrons, loved ones, and the like. To this end, chefs must prepare the individual ingredients such that the prepared meal is aesthetically pleasing to the patron. For example, carrots and cucumbers may have to be cut into small bite size pieces such that they are easily eaten and more appetizing. In another example, the individual ingredient may have to be sliced into varying thicknesses. One method of slicing food is to manually cut the food product (e.g., tomato, cucumber, carrot, etc.) with a chef knife and a cutting board. However, slicing food products with a chef knife requires a great deal of skill and practice. Otherwise, the sliced food product may be uneven and aesthetically unpleasing. Unfortunately, lay people are not as skillful with their chef knife to produce aesthetically pleasing sliced food products. Moreover, slicing food products with a chef knife is very time consuming.

Prior art food slicers have been manufactured to assist the lay person in quickly and efficiently slicing food products. These prior art food slicers may have a working surface upon which the food product may be cyclically slid upon to slice the food product. In particular, the working surface at a central portion thereof may have a blade with its knife edge directed toward a proximal end of the slicer. When the food product is traversed downward into the blade's edge, the food product is sliced and the sliced food product is urged under the slicer. The user may cyclically slide the food product up and down the working surface to produce aesthetically pleasing sliced food product.

Prior art food slicers may also have the ability to adjust the thickness of the sliced food product. For example, the slicer may be sold with a plurality of blades. Each of the blades when attached to the slicer may slice the food product at a different thickness. The user may cut different thicknesses of the food product by changing out the blade for a different blade to slice the food product at a particular thickness.

More particularly, the thickness of the sliced food is dependent upon a gap distance between the blade's knife edge and a trailing edge of an upper portion of the working surface. Each of the plurality of blades each have a knife edge that is further away or closer to the upper portion trailing edge when the blade is engaged to the slicer enabling the user to cut different thicknesses of food products. The working surface may be defined by the upper portion and a lower portion. The blade may be attached to the lower portion with the blade's knife edge directed toward a proximal end of the slicer. In this regard, as the food product is slid downward from the upper portion to the lower portion and downward pressure is applied to the food product as the food product passes over the blade's knife edge, the food product is sliced and the sliced food product is urged under the slicer (i.e., under the blade). Changing the blade for a different blade changes the gap distance between the blade's knife edge and the trailing edge of the upper portion of the working surface thereby changing the thickness of the sliced food product.

Unfortunately, the user's fingers are exposed to the sharp knife edge of the blade as the blade is being exchanged for another blade. Additionally, the time to change out the blades may be excessive because the blade already attached to the slicer must be removed, then the selected blade attached to the slicer. Moreover, since the plurality of blades are not always attached to the slicer, the blades may be lost or misplaced.

Accordingly, there is a need in the art for an improved food slicer.

BRIEF SUMMARY

The present invention addresses the needs discussed above as well as other needs identified herein and known in the art. A slicer having a handle and working surface is provided. A food product may be vertically slid up and down the working surface with the application of slight downward pressure to slice the food product. A blade may be engaged to side frames of the slicer between the stationary surface and the adjustable surface. The blade's side may be flush with the stationary surface and a knife edge of the blade may be directed toward the proximal side of the slicer. Additionally, a trailing edge of the adjustable surface may be offset with respect to the blade's knife edge. The offset is defined by the vertical distance between the blade's edge and the adjustable surface trailing edge. Accordingly, the food product may be sliced into slices of food product each time the food product is slid from the adjustable surface to the stationary surface over the blade. The sliced food product is sliced then urged and collected under the slicer.

The adjustable surface may be pivotally adjusted such that the offset may be easily changed. By way of example, and not limitation, a cam having a plurality of cam surfaces may be disposed under the adjustable surface. Each of the cam surfaces may have a different distance to a rotating axis of the cam. The user may easily rotate the cam such that changing the thickness setting of the slicer may be accomplished within a matter of seconds.

The cam may be locked by a pin at a distal end of the cam that is receiveable into one of a plurality of recesses formed in a base. The insertion of the pin into one of the recesses also aligns a corresponding cam surface adjacent to the adjustable surfaces' underside.

Indicia may be formed on the cam surfaces to indicate to the user the thickness setting of the slicer.

A hand guard for protecting the user's fingers from being cut by the blade may engage the food product. With the food product engaged to the hand guard, the user may cyclically traverse the food product from the stationary surface to the adjustable surface with downward pressure to slice the food product.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
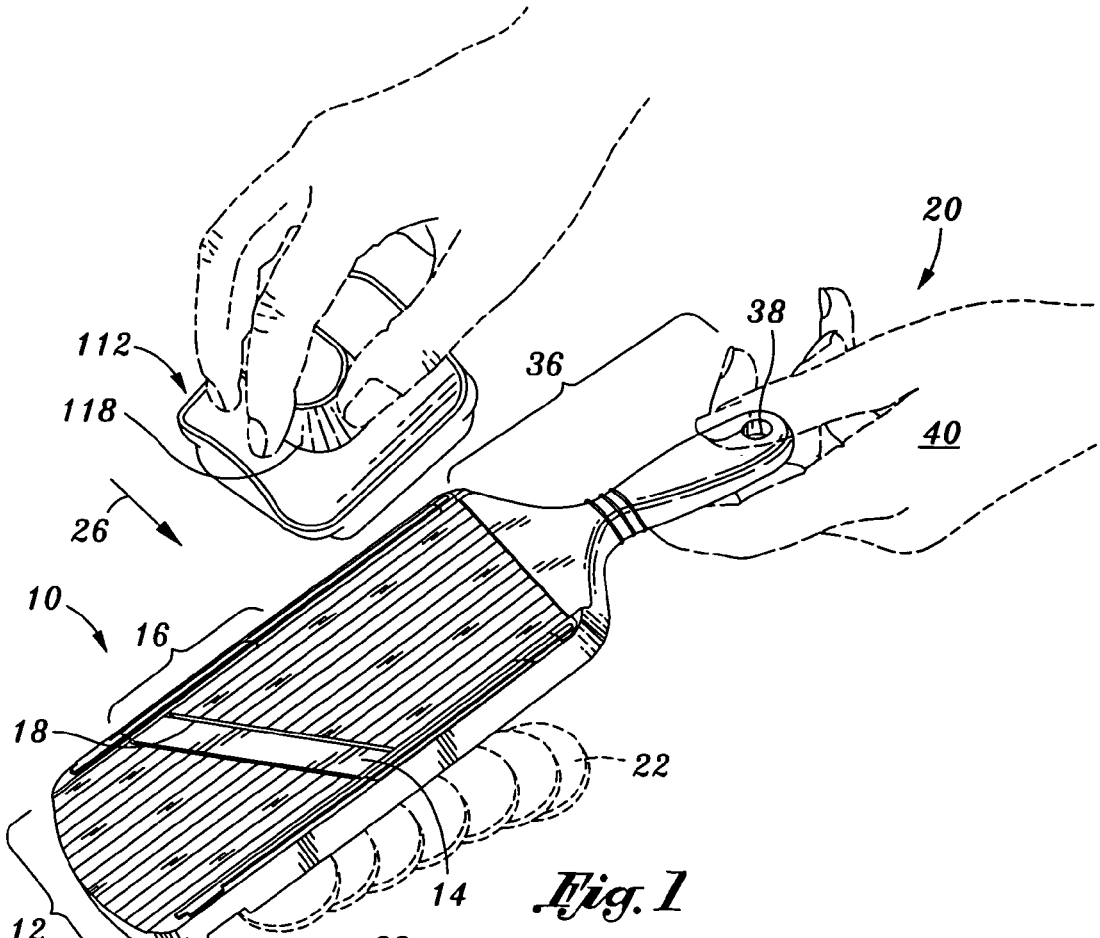
FIG. 1 is a perspective view of a food slicer and a hand guard, the food slicer is for slicing a food product wherein the food slicer may be set to slice the food product at different thicknesses, and the hand guard is for engaging the food product and traversing the food product across a blade of the food slicer to slice the food product.

Referring now to FIG. 1, a food slicer 10 is shown. The food slicer 10 has a working surface 12 incorporating a blade 14 at a central portion 16 thereof. A sharp edge 18 of the blade 14 may be directed toward the proximate side 20 of the slicer 10 such that food products 22 such as tomatoes, onions, etc. may be slid down the working surface 12 toward a distal side 24 of the slicer 10 across the blade 14 with the application of slight downward pressure (see arrow 26) to slice the food product 22.

Figure 2:
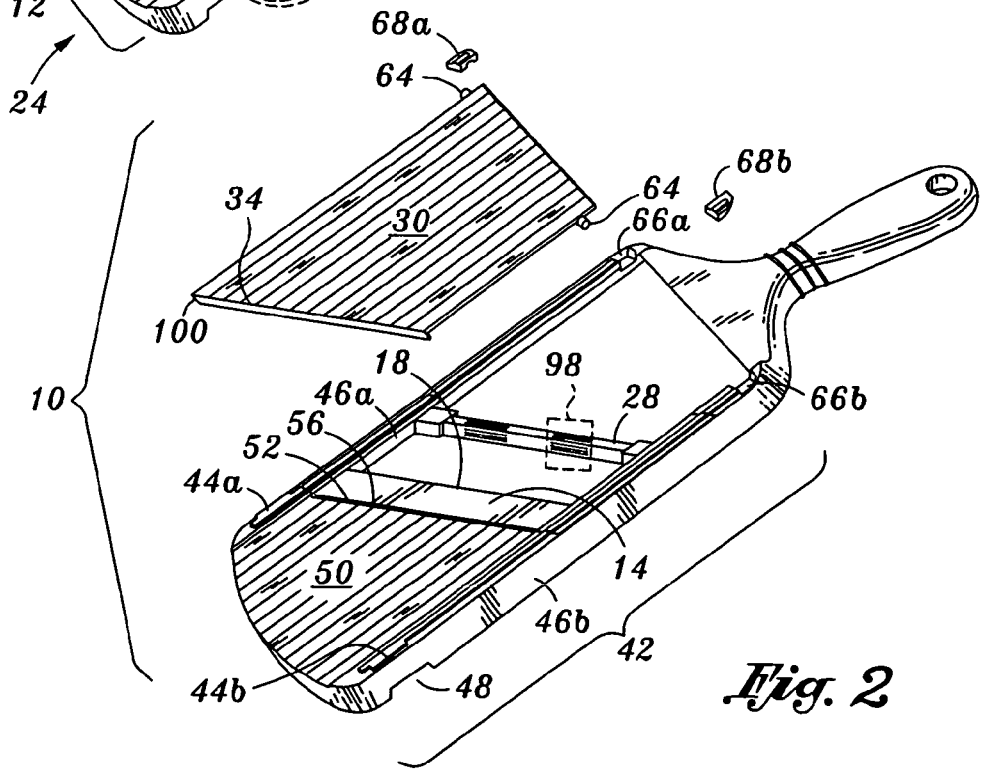
FIG. 2 is an exploded view of the food slicer shown in FIG. 1 illustrating posts of an adjustable surface receiveable into recessed portions of side frames of a body wherein the posts are retained therein via caps.

The slicer 10 is adjustable allowing the user to slice food products 22 with different thicknesses. By way of example and not limitation, the user may adjust the slicer 10 to slice food products 22 as thin sliced food products (e.g., 0.5 mm thick), medium sliced food products (e.g., 1.3 mm thick), thick sliced food products (e.g., 2.0 mm thick), and very thick sliced food products (e.g., 3.0 mm thick). For example, the user may slice a food product 22 with a first thickness (e.g., 0.5, 1.3, 2.0, or 3.0 mm) via the slicer 10. After the user has finished slicing the food product 22 at the first thickness, the user may adjust the thickness setting of the slicer 10 within a matter of seconds. The ease at which the slicer 10 may be set at the various thickness settings is enabled by a selectively rotatable cam 28 in contact with an adjustable surface 30 of the working surface 12, as shown in FIG. 2. Selectively rotating the cam 28 (see FIG. 2) changes a gap distance 32 (FIGS. 3A and 6-9) defined by the blade's edge 18 and a trailing edge 34 of the adjustable surface 30 to allow the user to set the slicing thickness setting of the slicer 10 within seconds. These as well as other advantages of the slicer 10 will be discussed below.

Figure 4:
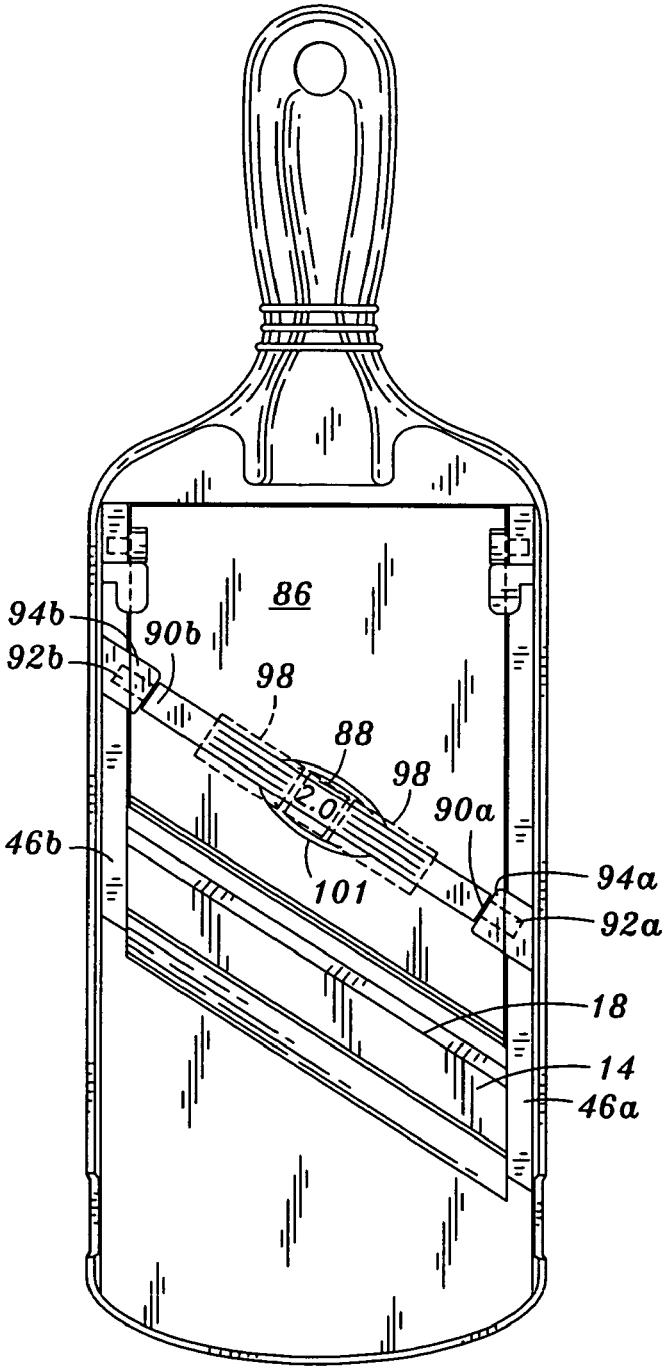
FIG. 4 is a bottom view of the food slicer shown in FIG. 1 illustrating a cam with a plurality of cam surfaces to regulate the gap distance.

The working surface 12 of the slicer 10 may be connected to or attached to a handle 36, as shown in FIG. 1. The handle 36 may have an aperture 38 for hanging the slicer 10 on a hook to conveniently store the slicer 10 when not in use. The handle 36 may be sized and configured to be grasped by a user's hand 40 while the user is slicing food products 22. The handle 36 may be ergonomically contoured to be comfortably grasped by the user during the slicing operation. In particular, the handle 36 may have a bowling pin shape, specifically, a small bulbous configuration at a proximal side that curvaceously narrows then widens as it connects to the working surface 12. The small bulbous configured proximal side may fit within the palm of the user's hand while the narrowing section may be grasped by the user's fingers. As shown in FIG. 4, the underside of the handle 36 may be hollowed out to reduce the weight of the slicer 10 such that the user is not fatigued by having to support a heavy slicer 10 during the slicing operation.

As shown in FIG. 2, the body 42 of the slicer 10 may include the working surface 12, a set of parallel elongate shoulders 44*a, b* which confines the food product 22 on the working surface 12, and side frames 46*a, b* with corner notches 48 operative to engage a lip of a bowl. The working surface 12 may have two different surfaces, namely, a stationary surface 50 and the adjustable surface 30. The stationary surface 50 may be at the distal end 24 of the slicer 10, whereas, the adjustable surface 30 may be at the proximal end 20 of the slicer 10. The stationary surface 50 may define a plane which is substantially in the same plane as the plane of the adjustable surface 30 such that the food product 22 may reciprocally slide between the stationary surface 50 and the adjustable surface 30. Typically, when the slicer 10 is in use, the trailing edge 34 of the adjustable surface 30 is at a lower level compared to the stationary surface 50, as shown in FIGS. 6-9. On the down stroke, the food product 22 slides from the adjustable surface 30 to the stationary surface 50. If a blade was not disposed adjacent a leading edge 52 (see FIGS. 2 and 3) of the stationary surface 50, then the side of the food product 22 would bump into the stationary surface's leading edge 52. Fortunately, the blade 14 is disposed in front of the leading edge 52 of the stationary surface 50 with the blade's edge 18 directed toward the proximal side 20 of the slicer 10, an upper surface 54 (see FIG. 5) of the blade 14 is flush with the plane of the stationary surface 50, and a trailing edge 56 (see FIGS. 2 and 3) of the blade 14 is closely adjacent and/or parallel to the leading edge 52 of the stationary surface 50. Accordingly, as the food product 22 slides from the adjustable surface 30 to the stationary surface 50, the blade 14 cuts or slices away a portion of the food product 22 and allows the remainder of the food product 22 to slide onto the stationary surface 50. The portion of the food product 22 that has been cut away is sliced and is directed underneath the slicer 10, as shown in FIG. 1. When the unsliced food product 22 is slid upward onto the working surface 12, the food product 22 may drop onto the adjustable surface 30. The unsliced food product 22 may be cyclically slid downwardly and upwardly until the entire food product is sliced.

Figure 5:
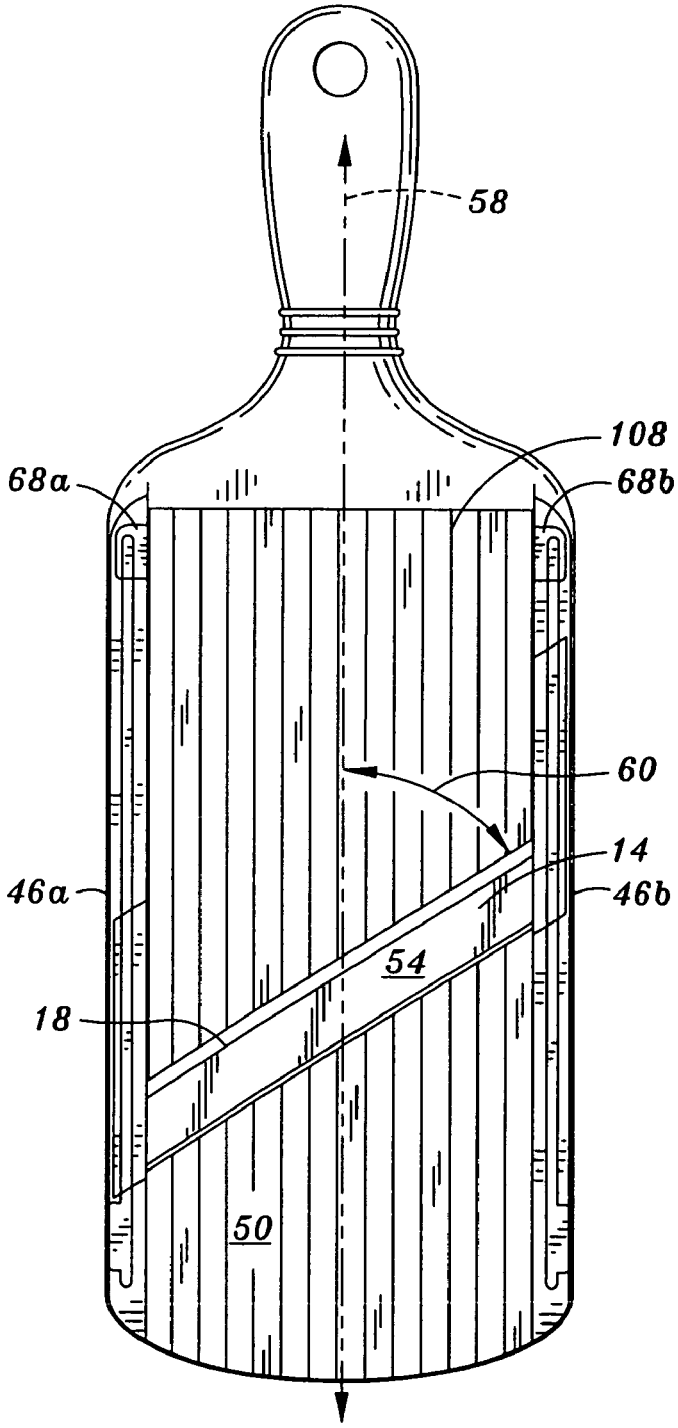
FIG. 5 is a top view of the food slicer shown in FIG. 1 illustrating a handle, the adjustable surface, the stationary surface and the blade interposed between the stationary and adjustable surfaces.

The blade 14 may be disposed adjacent the proximal side of the stationary surface 50 at a skewed angle with respect to a vertical direction 58 of cyclical travel of the food product 22, as shown in FIG. 5. More particularly, the blade 14 may be attached to the side frames 46*a, b* (see FIGS. 4 and 5) such that its knife edge 18 is at a skewed angle with respect to the vertical direction 58 of the cyclical travel of the food product 22. As stated above, the food product 22 may be cyclically slid up and down vertically 58 to slice the food product 22. The blade 14 may be attached to the side frames 46*a, b* at an angle 60 between about thirty-five (35) degrees to about seventy five (75) degrees. Preferably, the blade is attached to the stationary surface at an angle of about fifty five (55) degrees.

Figure 3:
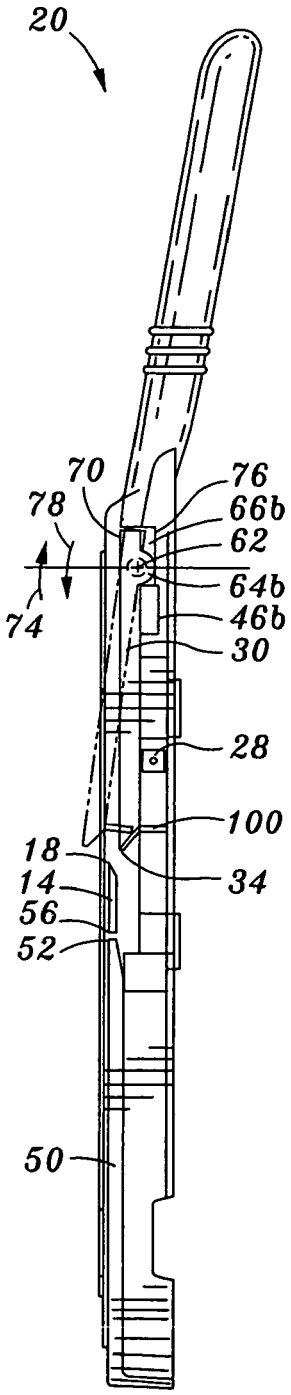
FIG. 3 is a right side view of the food slicer shown in FIG. 1 illustrating the adjustable surface being pivotable about a pivot point and a gap distance (i.e., offset) defined by a trailing edge of the adjustable surface and an edge of the blade.
Figure 3A:
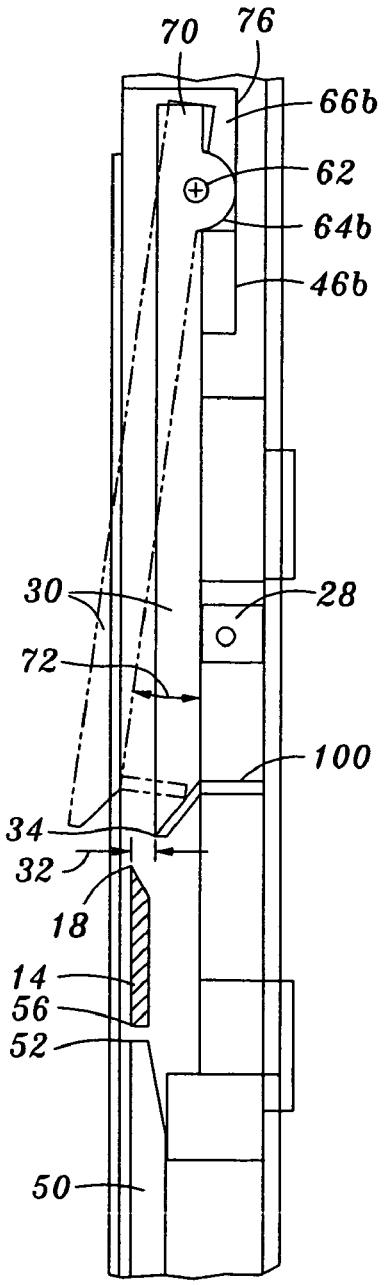
FIG. 3A is an enlarged view of FIG. 3.

The adjustable surface 30 may pivot about pivot point 62 at the proximal end 20 of the working surface 12. More particularly, as shown in FIGS. 2, 3, and 3A the adjustable surface 30 may have a pair of posts 64*a, b* at a proximal end of the adjustable surface 30. The posts 64 may rotateably engage recessed portions 66*a, b* of the side frames 46*a, b*. Once the posts 64 are received into the recessed portions 66, they 64 may be retained therein 66 by locking caps 68*a, b* (see FIGS. 2 and 5) onto the recessed portions 66 to prevent the posts 64 from slipping out of the recessed portions 66. It is contemplated that the adjustable surface 30 be upwardly or downwardly biased such as with a spring.

Stops 70 may also be received into the recessed portions 66, as shown in FIGS. 3 and 3A. The stops 70 extend away from the posts 64 toward the proximal side 20 of the slicer 10. The stops 70 and the posts 64 cooperate with each other to permit the adjustable surface 30 to pivot about the pivot point 62 but only to an upper pivot angle 72 limited by the stops 70. In particular, the adjustable surface 30 is pivotable about the pivot point 62 in the clockwise direction 74. The posts 64 having a circular configuration rolls on the bottom surfaces 76 of the recessed portions 66*a, b*. As the posts 64 continue to roll on the bottom surfaces 76, the stops 70 approach the bottom surfaces 76. When the stops 70 contact the bottom surfaces 76, then the adjustable surface 30 cannot continue to rotate in the clockwise direction 74 (see FIG. 3). This defines the upper pivot angle 72 of the adjustable surface 30. Preferably, the trailing edge 34 of the adjustable surface 30 is flush with the plane of the stationary surface 50 or slightly above the stationary surface plane (see FIGS. 3 and 3A) when the adjustable surface 30 is pivoted to the upper pivot angle 72.

From the upper pivot angle 72, the adjustable surface 30 may rotate in the counterclockwise direction 78 (see FIG. 3). The posts 64 roll on the bottom surfaces 76 of the recessed portions 66. As the posts 64 continue to roll on the bottom surfaces 76 of the recessed portions 66, an underside of the adjustable surface 30 approaches the cam 28. When the adjustable surface's underside contacts the cam 28, the adjustable surface 30 is prevented from pivoting any further. This defines a lower pivot angle 80 of the adjustable surface 30. FIGS. 6-9 illustrates four different lower pivot angles 80*a-d*. Accordingly, the adjustable surface 30 may pivot about the pivot point 62 between the upper pivot angle 72 and the lower pivot angle 80.

Figure 6:
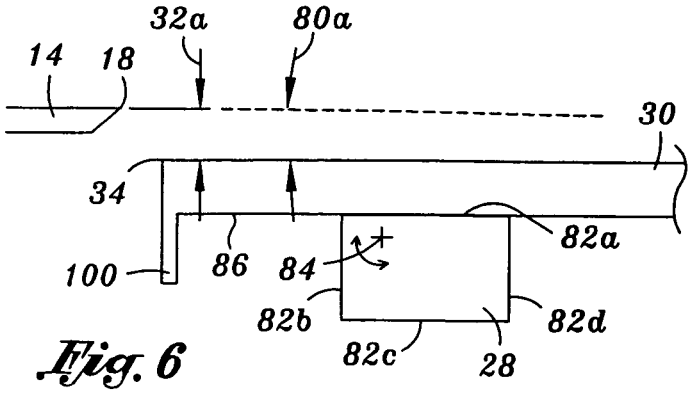
FIG. 6 is a cross sectional view of the cam, adjustable surface and blade with a first cam surface adjacent to an underside of the adjustable surface.
Figure 7:
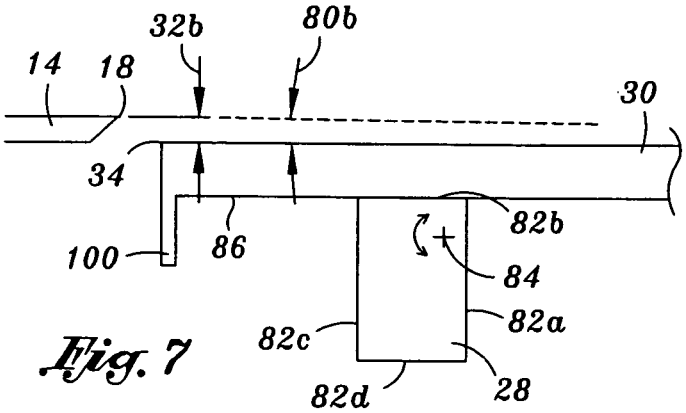
FIG. 7 is a cross sectional view of the cam, adjustable surface and blade with a second cam surface adjacent to the underside of the adjustable surface.
Figure 8:
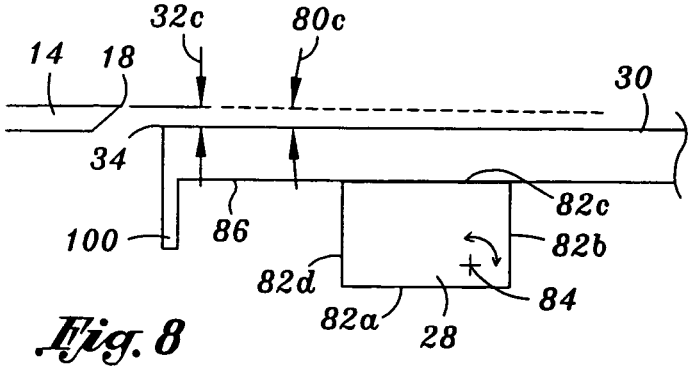
FIG. 8 is a cross sectional view of the cam, adjustable surface and blade with a third cam surface adjacent to the underside of the adjustable surface.
Figure 9:
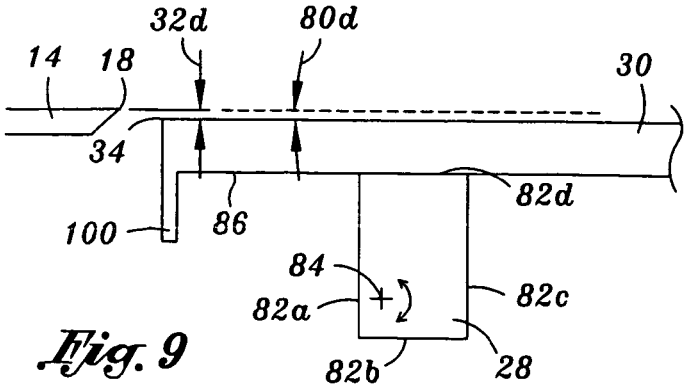
FIG. 9 is a cross sectional view of the cam, adjustable surface and blade with a fourth cam surface adjacent to the underside of the adjustable surface.

As can be seen from FIGS. 6-9, the gap 32 is defined by a distance between the trailing edge 34 of the adjustable surface 30 and the knife edge 18 of the blade 14. The gap distance 32 defines the thickness at which the slicer 10 slices the food product 22. Generally, the greater the gap distance 32, the thicker the slices of food product, as shown in FIG. 6. Conversely, the smaller the gap distance 32, the thinner the slices of food product, as shown in FIG. 9. The gap distance 32 may be easily adjusted to permit the user to change the thickness of the sliced food product 22 within a matter of seconds. This is accomplished by rotating the cam 28 such that the lower pivot angle 80 of the adjustable surface 30 is reset thereby changing the relative position of the adjustable surface's trailing edge 34 to the blade's knife edge 18 as shown in FIGS. 6-9.

Each of the cam surfaces 82*a-d* may have a different distance to a rotating axis 84 of the cam 28. The first cam surface 82*a* may be the closest to the cam rotating axis 84, as shown in FIG. 6. The second cam surface 82*b* may be slightly further away from the cam rotating axis 84, as shown in FIG. 7. The third cam surface 82*c* may be even slightly further away from the cam rotating axis 84 compared to the second cam surface 82*b*, as shown in FIG. 8. The fourth cam surface 82*d* may be the furthest away from the cam rotating axis 84, as shown in FIG. 9.

When the first cam surface 82*a* contacts the adjustable surface's underside 86, the lower pivot angle 80*a* and the gap distance 32*a* may be at a maximum, as shown in FIG. 6. When the second cam surface 82*b* contacts the adjustable surface's underside 86, the lower pivot angle 80*b* and the gap distance 32*b* may correspondingly decrease, as shown in FIG. 7. Furthermore, when the third cam surface 82*c* contacts the adjustable surface's underside 86, the lower pivot angle 80*c* and the gap distance 32*c* may be further decreased, as shown in FIG. 8. Lastly, when the fourth cam surface 82*d* contacts the adjustable surface's underside 86, the lower pivot angle 80*d* and the gap distance 32*d* may be at its minimum, as shown in FIG. 9. Accordingly, to slice the thickest slice of food product 22, the cam 28 is rotated such that its first cam surface 82*a* is adjacent to the adjustable surface's underside 86 and contactable therewith, as shown in FIG. 6. Conversely, to slice the thinnest slice of food product 22, the cam 28 is rotated such that its fourth cam surface 82*d* is adjacent to the adjustable surface's underside 86 and contactable therewith, as shown in FIG. 9. The slicer 10 permits the user to slice food products 22 with different thicknesses by merely rotating the cam 28 such that one of the four cam surfaces 82*a-d* is adjacent to the adjustable surface's underside 86.

The figures used in describing the slicer 10 show the cam 28 as having only four sides or four cam surfaces 82*a, b, c, d*. However, the figures are merely for the purposes of illustration and not limitation. As such, it is also contemplated within the scope of the present invention that the cam 28 may have a plurality (i.e., two, three, four, five or more) of sides or cam surfaces 82. It is not necessary that all cam surfaces have a different distance to the rotating axis 84 but it is preferable that at least two cam surfaces have a different distance to the rotating axis. In FIGS. 6-9, the cam 28 is shown as having a rectangular cross sectional configuration. However, it is also contemplated that the cam may have a square cross sectional configuration with the rotating axis 84 being vertically and horizontally offset from a center of the cam, and the vertical offset being different from the horizontal offset. Moreover, the cam surfaces may be defined by a spiral configuration. In particular, the rotating axis 84 may define a center of a spiral. A plurality of cam surfaces may be formed as tangent surfaces to the spiral. Alternatively, the cam 28 may have a single cam surface with a spiral shape wherein the cam 28 may be fixedly rotated to reset the gap distance 32.

The cam surfaces 82*a-d* may also have indicia 88 (see FIG. 4) formed thereon to indicate the slicing thickness setting of the slicer 10. For example, as shown in FIG. 4, when the cam 28 is rotated such that the second cam surface 82*b* is adjacent the adjustable surface's underside 86, the fourth cam surface 82*d* is visibly exposed to the user. The fourth cam surface 82*d* may have indicia 88 formed thereon indicating that the slicer is set to cut thick slices of food product 22. Likewise, when the first, third, and fourth cam surfaces 82*a, c, d* contact the adjustable surface's underside 86, the third, first, and second cam surfaces 82*c, a, b* are visibly exposed to the user, respectively. As such, indicia 88 may be formed on the third, first and second cam surfaces 82*c, a, b* indicating the thickness setting of the slicer 10.

Figure 10:
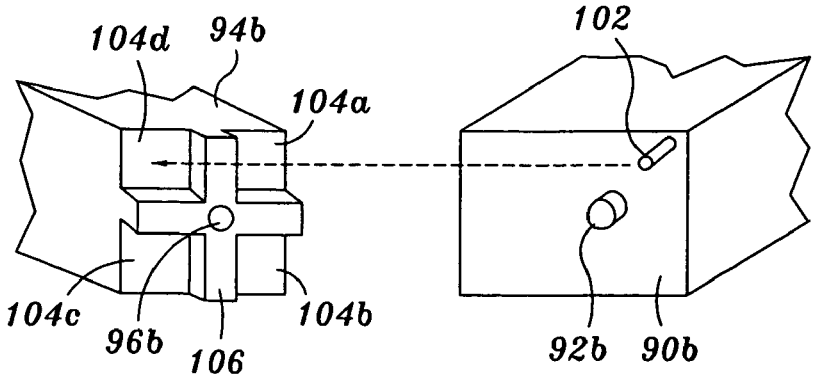
FIG. 10 is an exploded perspective view of a distal end of the cam with a pin selectively insertable into one of four recesses formed in a base.

The cam 28 may have an elongate rectangular configuration, as shown in FIGS. 2 and 6-9. Distal ends 90*a, b* of the cam 28 may have pins 92*a, b* that protrude out therefrom, as shown in FIG. 4. The pins 92*a, b* define the cam rotating axis 84 (see FIGS. 6-9). The pins 92*a, b* are receivable into bases 94 affixed to side frames 46 of the body 42. More particularly, as shown in FIG. 10, the pins 92*a, b* are receivable into base apertures 96*a, b*. The bases 94*a, b* may be affixed to the side frames 46*a, b* such that the cam 28 is parallel to the blade edge 18.

The cam 28 may further have gripping formations 98 (see FIGS. 2 and 4) on each of the cam surfaces. The gripping formations may be a plurality of linear indentations oriented along the length of the cam 28. The user may grasp the gripping formations 98 to rotate the cam 28 to change the slicer's thickness setting. These gripping formations 98 increase the frictional forces between the user's fingers and the cam 28 such that the user's fingers do not slip off of the cam 28 and are not accidentally cut by the blade 14. To further prevent the possibility of the blade 14 cutting the user's fingers while rotating the cam 28 or using the slicer 10, the distal end of the adjustable surface 30 may have a protective lip 100, as shown in FIGS. 2, 3 and 6-9. The protective lip 100 may extend downwardly between the blade's edge 18 and the cam 28. In this manner, the user's fingers bumps into the protective lip 100 when the user's fingers slips off of the cam 28 while rotating the cam 28. Preferably, the protective lip 100 extends downwardly beyond the blade's edge 18 such that the blade's edge 18 is not exposed when the adjustable surface 30 is pivoted to the upper pivot angle 72, as shown in FIG. 3. To further assist the user in rotating the cam 28, the adjustable surface underside 86 may be formed within an indentation 101 providing space for the user's fingers as the cam 28 is being rotated.

The slicer 10 may slice food products 22 at a consistent thickness. However, the thickness setting of the slicer 10 may inadvertently be changed if the cam 28 is inadvertently rotated. To prevent the cam 28 from being inadvertently rotated, a distal end 90 of the cam 28 may have a nub 102 that protrudes therefrom, as shown in FIG. 10. The nub 102 may be received into one of a plurality of recesses 104*a-d* formed in a mating distal end of the base 94. The recesses 104*a-d* may be defined by a cross configured ridge 106. There may be a respective number of recesses 104*a-d* as there are cam surfaces 82. When the nub 102 is received into one of the recesses 104*a-d*, then a respective one of the cam surfaces 82 may be aligned to the underside 86 of the adjustable surface 30. Since the nub 102 is inserted into one of the recesses 104*a-d*, the cam 28 is limited in its rotational movement.

The user may rotate the cam 28 by removing the nub 102 from the recess 104 and inserting the nub into an adjacent recess 104. The nub 102 may be removed from one of the recesses 104 to another one of the recesses 104 because the bases 94*a, b* may be pushed away from the nub 102. To this end, as shown in FIG. 4, the bases 94*a, b* are affixed to the side frames 46*a, b*. The side frames 46*a, b* may be fabricated from plastic which may be flexed. As such, the side frame 46*a, b* may flex outwardly to allow the nub 102 to slide over the cross configured ridge 106, as shown in FIG. 4. As the cam 28 is rotated, the nub 102 is received into an adjacent recess 104. When the nub 102 is received into the recess 104, the cam surface 82 is aligned to and adjacent the adjustable surface's underside 86. It is also contemplated that the cam 28 be biased toward the base 94 formed with the cross configured ridge 106 such as with a spring.

Figure 11:
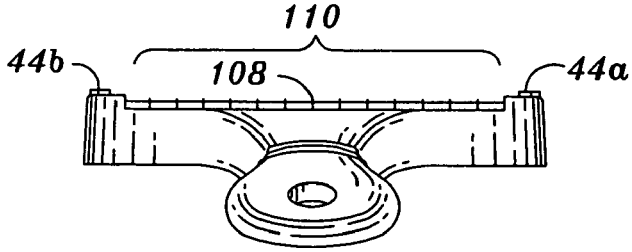
FIG. 11 is a rear view of the food slicer shown in FIG. 1 illustrating a pair of shoulders on opposed sides of a working surface and a plurality of ridges formed on the working surface to urge the food product on the working surface and between the shoulders.

The food product 22 may be urged to remain on the working surface 12 as the food product 22 is slid up and down the working surface 12 by the pair of shoulders 44*a, b* which enclose the working surface 12 and a plurality of vertically aligned ridges 108 integrally formed with the working surface 12, as shown in FIG. 11. The shoulders 44*a, b* are engaged to the side frames 46*a, b* of the body 42. The shoulders 44*a, b* are raised above the plane of the working surface 12. The shoulders 44*a, b* may extend substantially the entire length of the working surface 12. The shoulders 44*a, b* may also be parallel to each other and spaced apart from each other such that small to medium sized food products 22 may be sliced with the slicer 10. It is also contemplated that the slicer 10 may be sized to fit large sized food products 22. The shoulders 44*a, b* cooperatively form a channel 110 in which the food product 22 may slide as the food product 22 is traversed between the adjustable surface 30 and the stationary surface 50. If food product 22 veers to the left or right, then the food product 22 may bump into the respective shoulder 44*a, b* and be urged back toward the vertical center of the working surface 12.

The plurality of ridges 108 may extend the entire length of the adjustable surface 30. The ridges 108 may be equidistant apart from each other. The plurality of ridges 108 formed on the adjustable surface 30 may be aligned to the plurality of ridges 108 formed on the stationary surface 50. Similar to the ridges 108 formed on the adjustable surface 30, the ridges 108 formed on the stationary surface 50 may be equidistant from each other. The ridges 108 may be small protrusions which form grooves in the food product 22 as the food product 22 is slid up and down the working surface 12. The ridges 108 tend to remain in the grooves thereby promoting the food product 22 to stay on the working surface 12. In the event that the food product 22 veers to the left or right despite the urging of the ridges 108, the shoulders 44*a, b* prevent the food product 22 from slipping off of the working surface 12.

The slicer 10 may be placed on top of a container while slicing the food product 22. The food product 22 as it is being slice is urged under the slicer 10 and into the container. The slicer's side frames 46*a, b* may be formed with notches 48 (see FIG. 2) that engage the container's lip such that the slicer does not slip, slide or move as the user is slicing the food product 22. At least one notch 48 may be formed in each of the side frames 46*a, b* of the slicer body 42. The notch 48 may be formed at a distal end of the side frame 46*a, b*. The notch 48 may have an inverted V shape with a flat bottom. The width of the flat bottom may be sized and configured to receive the lip of the container.

In use, a bowl having a lip may be used to collect sliced food product 22 as the slicer 10 slices the food product 22. First, the slicing thickness may be selected by rotating the cam 28. Second, the notches 48 may receive the lip of the bowl. Third, the user may grasp the handle 36 and apply downward pressure on the adjustable surface 30 with the food product 22. Fourth, the user may slide the food product 22 from the adjustable surface 30 to the stationary surface 50. As the food product 22 is slid from the adjustable surface 30 to the stationary surface 50, the blade 14 slices the food product 22. The remaining food product 22 is slid onto the stationary surface 50, and the sliced food product 22 is urged under the slicer 10 and into the bowl. This process may be repeated until the entire food product 22 is sliced.

Alternatively, in the second step, the notches 48 may receive the bowl lip, and additionally, the proximal end 20 of the slicer 10 may be laid on an opposing side of the bowl lip such that the slicer 10 is fully supported by lip of the bowl. The user may continue to slice the food product 22 as described above.

As shown in FIG. 1, a hand guard 112 may be used in conjunction with the slicer 10 to grasp the food product 22 as it is being reciprocally slid over the blade 14. The hand guard 112 protects the user's fingers and hand from being cut by the blade 14 as the user is slicing the food product 22. Without the hand guard 112, the user grasps the food product 22 with his/her fingers and reciprocally moves the food product 22 between the adjustable surface 30 and the stationary surface 50 to slice the food product 22. As the user continues to the slice the food product 22, the user's fingers approaches the blade's edge 18. The user may attempt to slice the entire food product 22 with the slicer 10. However, such attempt may be dangerous because as more of the food product 22 is sliced, the grasping area of the food product 22 is reduced until the fingers are dangerously close to the blade edge 18.

Figure 12:
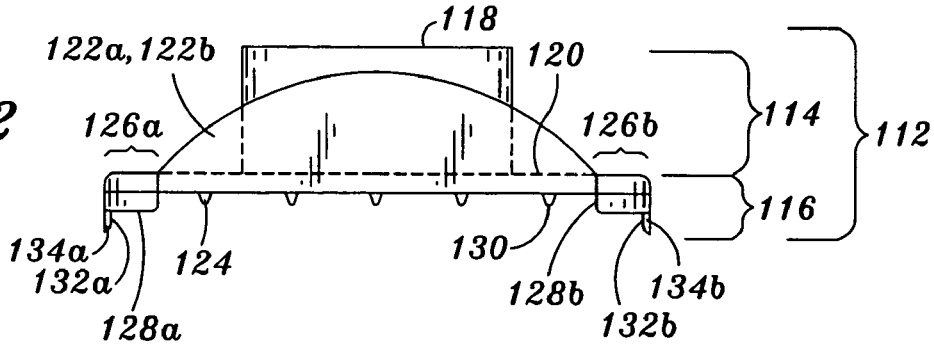
FIG. 12 is a front view of the hand guard shown in FIG. 1 illustrating a handle portion and a grasping portion wherein the grasping portion has mirror imaged left and right guides.
Figure 13:
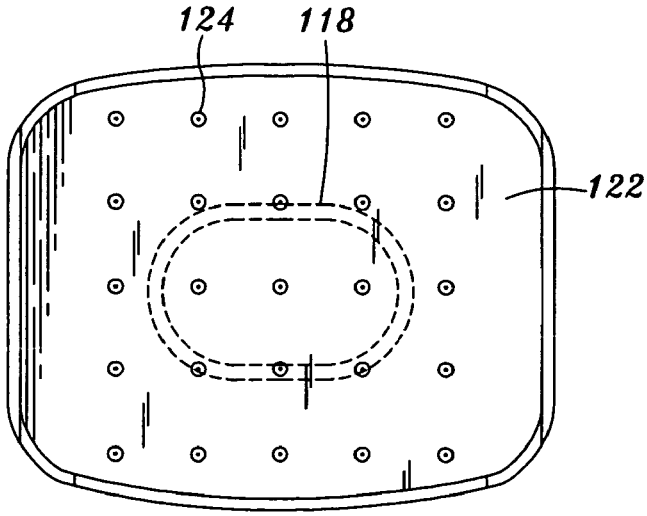
FIG. 13 is a bottom view of the hand guard shown in FIG. 1 illustrating a plurality of spikes for engaging the food product.

Referring now to FIGS. 12 and 13, the hand guard 112 may have a handle portion 114 and a food product grasping portion 116. The handle portion 114 may be grasped by the user's hand. The handle portion 114 may have a central ovular shaped protrusion 118 (see FIGS. 1 and 12) graspable by the user's fingers. Once the protrusion 118 is grasped by the user's fingers, then the user's finger tips may rest on a top flat surface 120 (see FIG. 12). A proximal end and a distal end of the hand guard 112 may have attached thereto a proximal finger guard 122*a* and a distal finger guard 122*b* (see FIG. 12), respectively. The finger guards 122*a, b* prevent the fingers from slipping off of the flat top surface 120 as the user is slicing the food product 22.

The grasping portion 116 of the hand guard 112 may be operative to engage a food product 22. The grasping portion 116 may include a bottom flat surface 122 opposed to the top flat surface 120, as shown in FIG. 13. A plurality of spikes 124 may be formed on the bottom flat surface 122 protruding downwardly. The spikes 124 may be pierced into the food product 22 to engage the food product 22.

Left and right guides 126*a, b* may be attached to the left and right sides of the hand guard 112. The left and right guides 126*a, b* guide the hand guard 112 vertically up and down the working surface 12. Also, the left and right guides 126*a, b* prevent the spikes 124 from being cut by the blade edge 18. The left and right guides 126*a, b* may each have a stair stepped configuration, as shown in FIG. 12. The left guide 126*a* may have a mirror configuration of the stair step configuration compared to the right guide 126*b*. The first steps 128*a, b* of the left and right guides 126*a, b* may be formed to be level with the spike's distal point 130, as shown in FIG. 12. The first steps 128*a, b* of the left and right guides 126*a, b* may slide on top of the left and right shoulders 44*a, b*, respectively.

Sidewalls 132*a, b* of second steps 134*a, b* may be disposed on the outer sides of the shoulders 44*a, b* when the first steps 128*a, b* contacts the shoulders 44*a, b*. The sidewalls 132*a, b* align the hand guard 112 from left to right as the user moves the hand guard 112 vertically up and down the working surface 12.

The above description is given by way of example, and not limitation. Given the above disclosure, one skilled in the art could devise variations that are within the scope and spirit of the invention disclosed herein, including various ways of urging the food product on the working surface. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of adjusting a slicing thickness of a slicer for slicing a food product with a selected slicing thickness, the method comprising the steps of:

a) providing a slicer comprising:

i) a frame defining a first recess and a second recess;

ii) a blade connected to the frame;

iii) an adjustable surface defining opposing lateral side portions, the adjustable surface being pivotally connected to the frame and settable closer to or further away from the blade, the adjustable surface defining an underside;

iv) a cam defining a first cam surface, a second cam surface, a gripping formation extending longitudinally along the cam, a distal end portion, and a nub protruding from the distal end portion, the first cam surface being at a different distance to a rotating axis of the cam compared to a distance from the second cam surface to the cam rotating axis, the first cam surface being disposable in contact with the adjustable surface underside to define a first orientation, the second cam surface being disposable in contact with the adjustable surface underside to define a second orientation, the cam being rotatable about the rotating axis to selectively dispose the cam in the first orientation and the second orientation for changing a gap distance between the adjustable surface and the blade, the nub being disposed within the first recess when the cam is in the first orientation, and the nub being disposed within the second recess when the cam is in the second orientation, the gripping formation being sized and configured to assist a user to rotate the cam;

b) rotating the cam to dispose the cam in one of the first orientation and the second orientation;

c) pushing and sliding the food product against the adjustable surface; and d) upon pushing the food product against the adjustable surface, pivoting the adjustable surface toward the cam and pushing the underside of the adjustable surface against the cam to set the gap distance.

2. The method as recited in claim 1, wherein step a) includes providing a slicer having a handle connected to the frame.

3. The method as recited in claim 1, wherein step a) includes providing a slicer having a blade that is skewed with respect to a travel path of the food product as the food product is being sliced.

4. A method of adjusting a slicing thickness of a slicer for slicing a food product with a selected slicing thickness, the method comprising the steps of:

a) providing a slicer comprising:

i) a flexible frame defining a first recess and a second recess, the frame being flexible between a flexed position and a relaxed position;

ii) a blade connected to the frame;

iii) an adjustable surface defining opposing lateral side portions, the adjustable surface being pivotally connected to the frame and settable closer to or further away from the blade, the adjustable surface defining an underside;

iv) a cam defining a first cam surface, a second cam surface, a distal end portion, and a nub protruding from a distal end portion, the first cam surface being at a different distance to a rotating axis of the cam compared to a distance from a second cam surface to the cam rotating axis, the first cam surface being disposable in contact with the adjustable surface underside to define a first orientation, the second cam surface being disposable in contact with the adjustable surface underside to define a second orientation, the cam being rotatable about the rotating axis to selectively dispose the cam in the first orientation and the second orientation for changing a gap distance between the adjustable surface and the blade, the number being disposed within the first recess when the cam is in the first orientation, and the nub being disposed within the second recess when the cam is in the second orientation, the nub being removable from the first recess and second recess when the frame is in the flexed position, the nub being disposable in the first recess when the frame is in the relaxed position and the cam is in the first orientation, the nub being disposable in the second recess when the frame is in the relaxed position and the cam is in the second orientations;

b) rotating the cam to dispose the cam in one of the first orientation and the second orientation;

c) pushing and sliding the food product against the adjustable surface; and d) upon pushing the food product against the adjustable surface, pivoting the adjustable surface toward the cam and pushing the underside of the adjustable surface against the cam to set the gap distance.

5. The method as recited in claim 4, further comprising the step of flexing the frame to remove the nub from one of the first recess and second recess.

6. A method of adjusting a slicing thickness of a slicer for slicing a food product with a selected slicing thickness, the method comprising the steps of:

a) providing a slicer comprising:

i) a frame defining a first recess and a second recess;

ii) a blade connected to the frame;

iii) an adjustable surface defining opposing lateral side portions, the adjustable surface being pivotally connected to the frame and settable closer to or further away from the blade, the adjustable surface defining an underside;

iv) a cam defining a first cam surface, a second cam surface, a distal end portion, and a nub protruding from the distal end portion, the first cam surface being at a different distance to a rotating axis of the cam compared to a distance from the second cam surface to the cam rotating axis, the first cam surface being disposable in contact with the adjustable surface underside to define a first orientation, the second cam surface being disposable in contact with the adjustable surface underside to define a second orientation, the cam being rotatable about the rotating axis to selectively dispose the cam in the first orientation and the second orientation for changing a gap distance between the adjustable surface and the blade, the nub being disposed within the first recess when the cam is in the first orientation, and the nub being disposed within the second recess when the cam is in the second orientation, the cam having indicia displayed on the cam to indicate a slicing thickness;

b) rotating the cam to dispose the cam in one of the first orientation and the second orientation;

c) pushing and sliding the food product against the adjustable surface; and d) upon pushing the food product against the adjustable surface, pivoting the adjustable surface toward the cam and pushing the underside of the adjustable surface against the cam to set the gap distance.

7. An adjustable slicer for slicing food products at a plurality of thicknesses, the slicer comprising:

a frame defining a first recess and a second recess;

a blade connected to the frame, the blade defining a blade edge;

an adjustable surface defining opposing lateral side portions, the adjustable surface being pivotally connected to the frame and disposed adjacent to the blade and defining a trailing edge, and the adjustable surface trailing edge and the blade edge defining a gap distance, the adjustable surface being settable closer to or further away from the blade edge to adjust the gap distance for slicing food products at the plurality of thicknesses, wherein the adjustable surface is pivotable about a pivot axis; and a rotatable cam having a first cam surface, a second cam surface, a distal end, a gripping formation extending longitudinally along the cam, and a nub protruding from the distal end, the first cam surface being at a different distance to a rotating axis of the cam compared to a distance from the second cam surface to the rotating axis, the first cam surface being disposable in contact with the adjustable surface underside to define a first orientation, the second cam surface being disposable in contact with the adjustable surface underside to define a second orientation, the cam being rotatable about the rotating axis to selectively dispose the cam in the first orientation and the second orientation for changing a gap distance between the adjustable surface and the blade, the nub being disposed within the first recess when the cam is in the first orientation, and the nub being disposed within the second recess when the cam is in the second orientation, the gripping formation being sized and configured to assist a user to rotate the cam.

8. An adjustable slicer for slicing food products at a plurality of thicknesses, the slicer comprising:

a frame defining a first recess and a second recess;

a blade connected to the frame, the blade defining a blade edge;

an adjustable surface defining opposing lateral side portions, the adjustable surface being pivotally connected to the frame and disposed adjacent to the blade and defining a trailing edge, and the adjustable surface trailing edge and the blade edge defining a gap distance, the adjustable surface being settable closer to or further away from the blade edge to adjust the gap distance for slicing food products at the plurality of thicknesses, wherein the adjustable surface is pivotable about a pivot axis; and a rotatable cam having a first cam surface, a second cam surface, a distal end, and a nub protruding from the distal end, the first cam surface being at a different distance to a rotating axis of the cam compared to a distance from the second cam surface to the rotating axis, the first cam surface being disposable in contact with the adjustable surface underside to define a first orientation, the second cam surface being disposable in contact with the adjustable surface underside to define a second orientation, the cam being rotatable about the rotating axis to selectively dispose the cam in the first orientation and the second orientation for changing a gap distance between the adjustable surface and the blade, the nub being disposed within the first recess when the cam is in the first orientation, and the nub being disposed within the second recess when the cam is in the second orientation, the cam including indicia displayed on the cam to indicate a slicing thickness.

9. An adjustable slicer for slicing food products at a plurality of thicknesses, the slicer comprising:

a frame defining a first recess and a second recess, the frame being flexible between a flexed position and a relaxed position;

a blade connected to the frame, the blade defining a blade edge;

an adjustable surface defining opposing lateral side portions, the adjustable surface being pivotally connected to the frame and disposed adjacent to the blade and defining a trailing edge, and the adjustable surface trailing edge and the blade edge defining a gap distance, the adjustable surface being settable closer to or further away from the blade edge to adjust the gap distance for slicing food products at the plurality of thicknesses, wherein the adjustable surface is pivotable about a pivot axis; and a rotatable cam having a first cam surface, a second cam surface, a distal end, and a nub protruding from the distal end, the first cam surface being at a different distance to a rotating axis of the cam compared to a distance from the second cam surface to the rotating axis, the first cam surface being disposable in contact with the adjustable surface underside to define a first orientation, the second cam surface being disposable in contact with the adjustable surface underside to define a second orientation, the cam being rotatable about the rotating axis to selectively dispose the cam in the first orientation and the second orientation for changing a gap distance between the adjustable surface and the blade, the nub being disposed within the first recess when the cam is in the first orientation, and the nub being disposed within the second recess when the cam is in the second orientation, the nub being removable from the first recess and second recess when the frame is in the flexed position, the nub being disposable in the first recess when the frame is in the relaxed position and the cam is in the first orientation, the nub being disposable in the second recess when the frame is in the relaxed position and the cam is in the second orientation.

10. The adjustable slicer as recited in claim 9, further comprising a handle connected to the frame.

11. The adjustable slicer as recited in claim 9, wherein the blade is skewed with respect to a travel path of the food product as the food product is being sliced.

12. The adjustable slicer as recited in claim 11, wherein the blade is skewed between about 35 degrees to about 75 degrees.

13. The adjustable slicer as recited in claim 12, wherein the blade is skewed about 55 degrees.

14. The adjustable slicer as recited in claim 9, further comprising a finger guard protruding from the underside of the adjustable surface.

* * * * *